US006398234B1

(12) United States Patent
Brown

(10) Patent No.: US 6,398,234 B1
(45) Date of Patent: Jun. 4, 2002

(54) TRANSFORMABLE MECHANIC'S CREEPER ASSEMBLY

(76) Inventor: Gary A. Brown, 6 Brookview Blvd., Chestnut Ridge, NY (US) 10977

( * ) Notice: Subject to any disclaimer, the term of this patent is extended or adjusted under 35 U.S.C. 154(b) by 0 days.

(21) Appl. No.: 09/616,911

(22) Filed: Jul. 14, 2000

(51) Int. Cl.[7] ..... B25H 5/00

(52) U.S. Cl. ..... 280/32.6; 280/79.2; 280/30; 297/129; 297/256.16

(58) Field of Search ..... 280/32.6, 32.5, 280/648, 650, 639, 35, 79.11, 79.2, 87.01, 640, 30, 87.05, 87.021; 301/9.1, 5.1; D34/27, 23, 12; 297/118, 129, 5, 250.1, 256.16; 5/652

(56) References Cited

U.S. PATENT DOCUMENTS

| | | | | | |
|---|---|---|---|---|---|
| 1,327,103 | A | | 1/1920 | Knowles | 280/32.6 |
| 1,394,493 | A | * | 10/1921 | Grazer | 280/32.6 |
| 2,595,783 | A | | 5/1952 | Griffin | 280/32.6 |
| 2,595,784 | A | * | 5/1952 | Griffin et al. | 280/79.2 |
| 4,580,799 | A | * | 4/1986 | Quinonez | 280/639 |
| D289,815 | S | | 5/1987 | Quinonez | D34/23 |
| D298,674 | S | | 11/1988 | Koller, Sr. | D34/23 |
| 4,792,147 | A | * | 12/1988 | Wissing | D34/23 |
| 4,889,352 | A | * | 12/1989 | Chamberlin, Jr. | 280/32.6 |
| 4,895,380 | A | | 1/1990 | Brooks et al. | 280/32.6 |
| 5,297,809 | A | * | 3/1994 | Chen | 280/32.6 |
| 5,451,068 | A | | 9/1995 | Shockley | 280/32.6 |
| 5,524,915 | A | * | 6/1996 | Liu | 280/32.6 X |
| 5,611,552 | A | * | 3/1997 | Miles et al. | 280/32.5 X |
| 5,707,067 | A | * | 1/1998 | Smith | 280/32.6 |
| 5,863,053 | A | * | 1/1999 | Berry | 280/32.6 |
| 5,947,489 | A | * | 9/1999 | Tucker | 280/32.6 |
| D431,705 | S | * | 10/2000 | Yuan | D34/23 |

* cited by examiner

*Primary Examiner*—Robert P. Olszewski
*Assistant Examiner*—F. Zeender

(57) ABSTRACT

A transformable mechanic's creeper assembly for providing support to the user in either a recumbent or sitting position with selectable height. The transformable mechanic's creeper assembly includes a first deck assembly, a seat assembly, a second deck assembly couplable to either the first deck assembly or the seat assembly, a plurality of spacing members couplable to the deck and seat assemblies adapted for adjusting the overall height of the assemblies, and a plurality of wheels couplable to the spacing members.

18 Claims, 3 Drawing Sheets

TRANSFORMABLE MECHANIC'S CREEPER ASSEMBLY

BACKGROUND OF THE INVENTION

1. Field of the Invention

The present invention relates to mechanics creepers and more particularly pertains to a new transformable mechanic's creeper assembly for providing support to the user in either a recumbent or sitting position with selectable height.

2. Description of the Prior Art

The use of mechanics creepers is known in the prior art. More specifically, mechanics creepers heretofore devised and utilized are known to; consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,595,783; 1,327,103; U.S. Pat. No. Des. 289,815; U.S. Pat. Nos. 4,895,380; 5,451,068; and U.S. Pat. No. Des. 298,674.

While these devices fulfill their respective, particular objectives and requirements, the aforementioned patents do not disclose a new transformable mechanic's creeper assembly. The inventive device includes a first deck assembly, a seat assembly, a second deck assembly couplable to either the first deck assembly or the seat assembly, a plurality of spacing members couplable to the deck and seat assemblies adapted for adjusting the overall height of the assemblies, and a plurality of wheels couplable to the spacing members.

In these respects, the transformable mechanic's creeper assembly according to the present invention substantially departs from the conventional concepts and designs of the prior art, and in so doing provides an apparatus primarily developed for the purpose of providing support to the user in either a recumbent or sitting position with selectable height.

SUMMARY OF THE INVENTION

In view of the foregoing disadvantages inherent in the known types of mechanics creepers now present in the prior art, the present invention provides a new transformable mechanic's creeper assembly construction wherein the same can be utilized for providing support to the user in either a recumbent or sitting position with selectable height.

The general purpose of the present invention, which will be described subsequently in greater detail, is to provide a new transformable mechanic's creeper assembly apparatus and method which has many of the advantages of the mechanics creepers mentioned heretofore and many novel features that result in a new transformable mechanic's creeper assembly which is not anticipated, rendered obvious, suggested, or even implied by any of the prior art mechanics creepers, either alone or in any combination thereof.

To attain this, the present invention generally comprises a first deck assembly, a seat assembly, a second deck assembly couplable to either the first deck assembly or the seat assembly, a plurality of spacing members couplable to the deck and seat assemblies adapted for adjusting the overall height of the assemblies, and a plurality of wheels couplable to the spacing members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new transformable mechanic's creeper assembly apparatus and method which has many of the advantages of the mechanics creepers mentioned heretofore and many novel features that result in a new transformable mechanic's creeper assembly which is not anticipated, rendered obvious, suggested, or even implied by any of the prior art mechanics creepers, either alone or in any combination thereof.

It is another object of the present invention to provide a new transformable mechanic's creeper assembly which may be easily and efficiently manufactured and marketed.

It is a further object of the present invention to provide a new transformable mechanic's creeper assembly which is of a durable and reliable construction.

An even further object of the present invention is to provide a new transformable mechanic's creeper assembly which is susceptible of a low cost of manufacture with regard to both materials and labor, and which accordingly is then susceptible of low prices of sale to the consuming public, thereby making such transformable mechanic's creeper assembly economically available to the buying public.

Still yet another object of the present invention is to provide a new transformable mechanic's creeper assembly which provides in the apparatuses and methods of the prior art some of the advantages thereof, while simultaneously overcoming some of the disadvantages normally associated therewith.

Still another object of the present invention is to provide a new transformable mechanic's creeper assembly for providing support to the user in either a recumbent or sitting position with selectable height.

Yet another object of the present invention is to provide a new transformable mechanic's creeper assembly which includes a first deck assembly, a seat assembly, a second deck assembly couplable to either the first deck assembly or the seat assembly, a plurality of spacing members couplable to the deck and seat assemblies adapted for adjusting the overall height of the assemblies, and a plurality of wheels couplable to the spacing members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
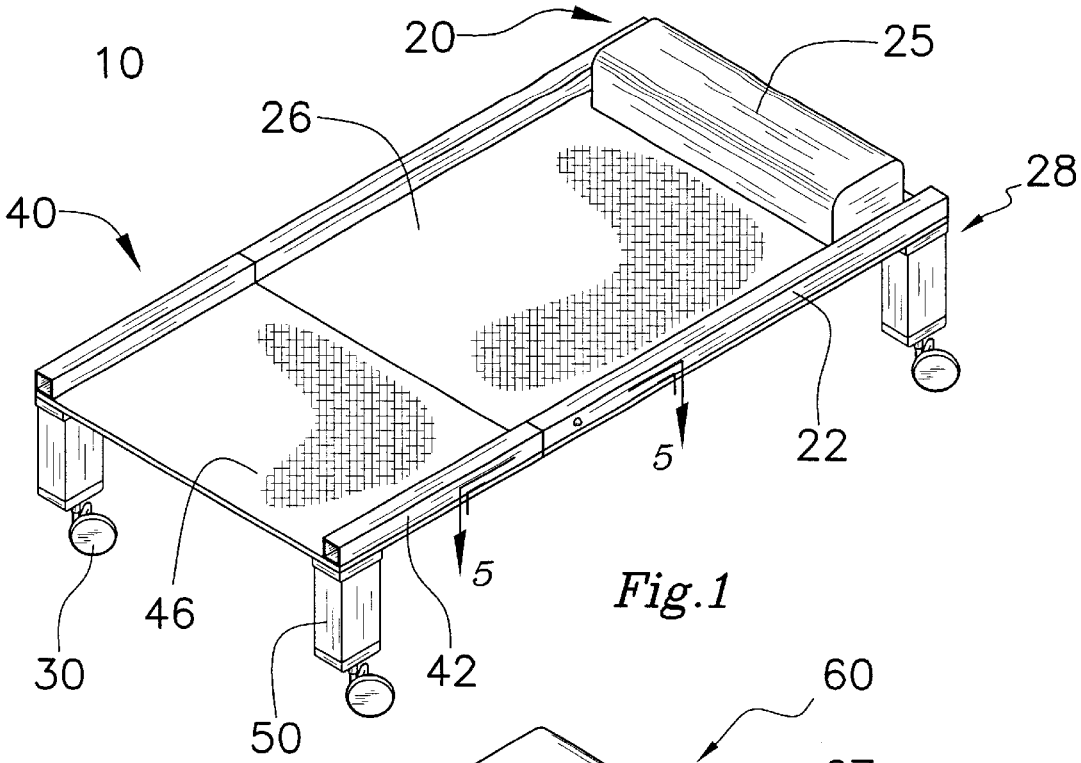
FIG. 1 is a schematic perspective view of a new transformable mechanic's creeper assembly according to the present invention.
Figure 2:
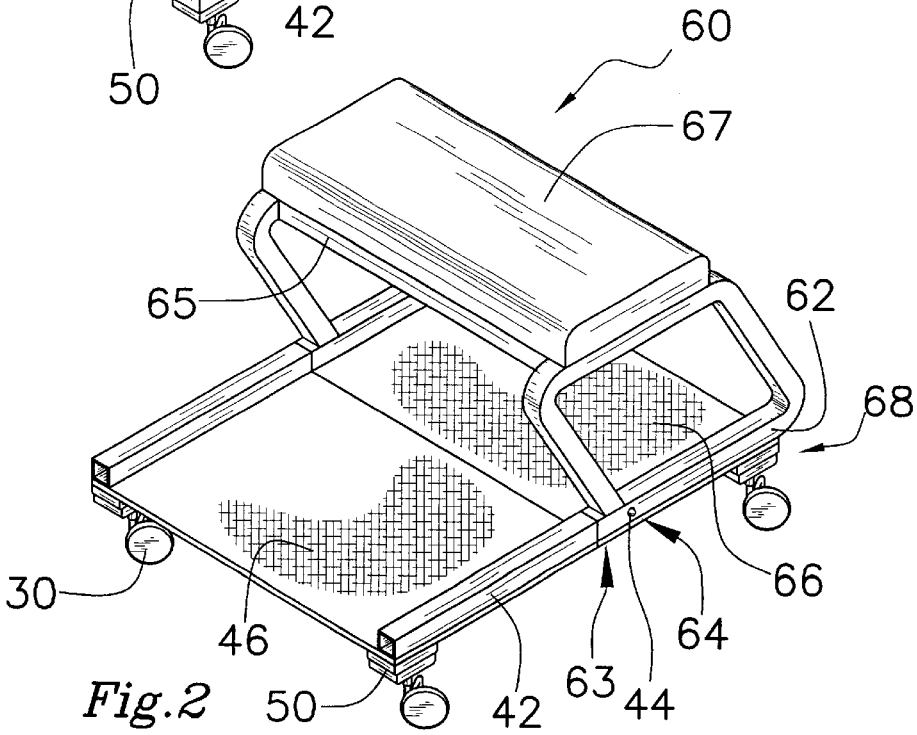
FIG. 2 is a schematic perspective view of the present invention.
Figure 3:
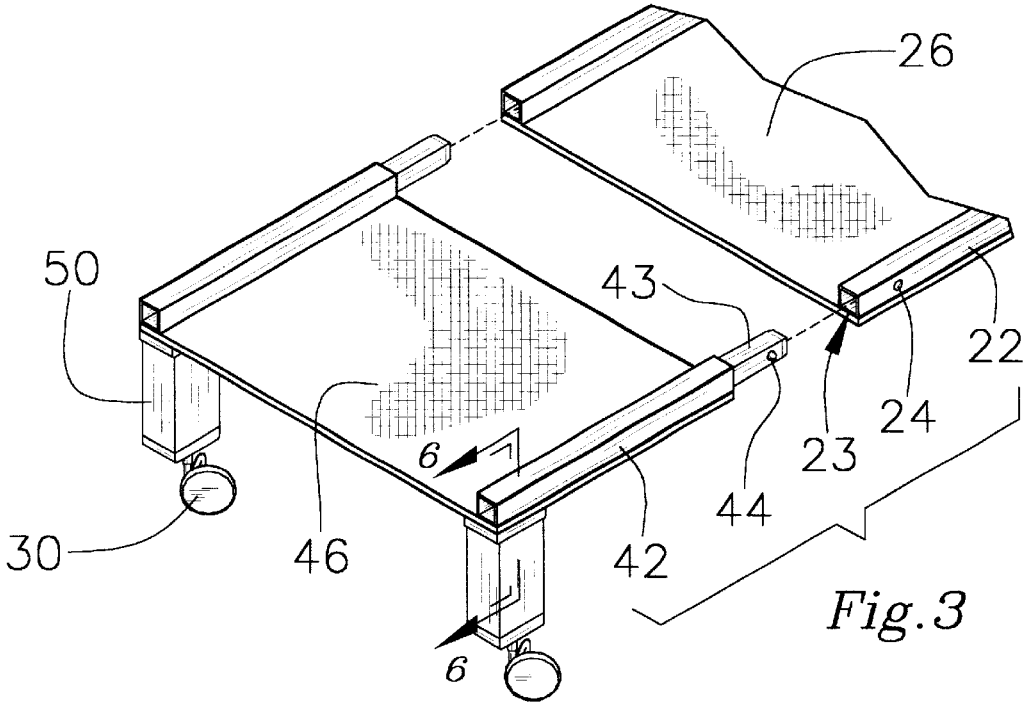
FIG. 3 is a schematic detail view of the connection portions of the present invention.
Figure 4:
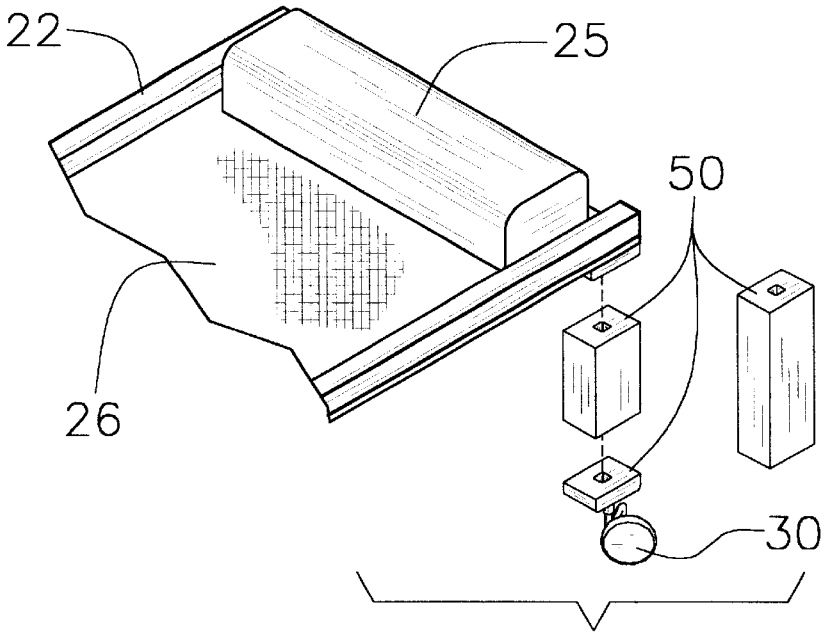
FIG. 4 is a schematic detail view of the spacing members of the present invention.
Figure 5:
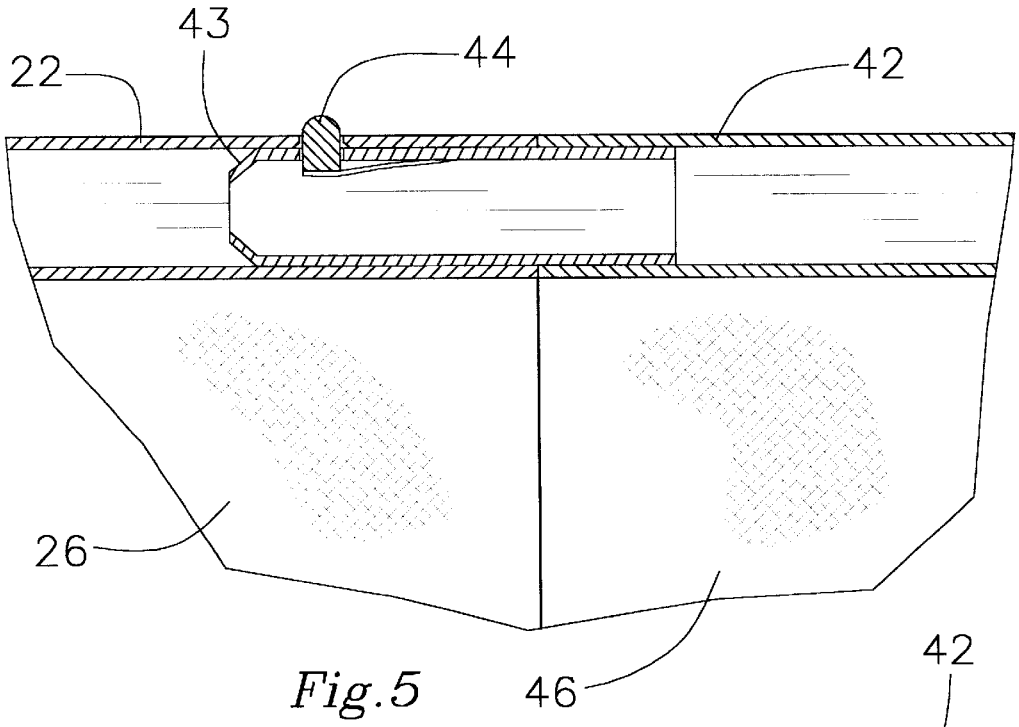
FIG. 5 is a schematic cross-sectional view of the present invention taken along line 5—5 of FIG. 1.
Figure 6:
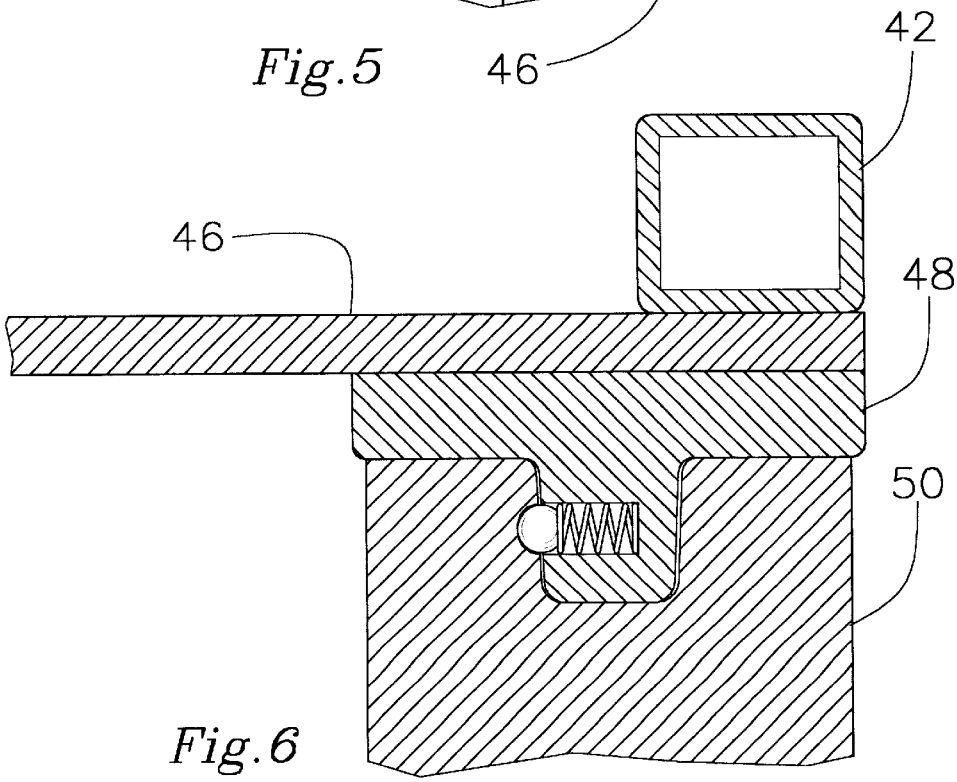
FIG. 6 is a schematic cross-sectional view of the present invention taken along line 6—6 of FIG. 3.

With reference now to the drawings, and in particular to FIGS. 1 through 6 thereof, a new transformable mechanic's creeper assembly embodying the principles and concepts of the present invention and generally designated by the reference numeral 10 will be described.

As best illustrated in FIGS. 1 through 6, the transformable mechanic's creeper assembly 10 generally comprises a first deck assembly 20, a second deck assembly 40, a seat assembly 60, a plurality of wheel assemblies 30, and a plurality of spacing members 50.

The first deck assembly 20 includes a pair of first deck side rails 22 and a planar first deck support plate 26 which extends between the first deck side rails 22. Each of the first deck side rails 22 includes an associated open end 23 and an associated aperture 24 positioned in an outwardly facing wall of the associated side rail 22.

The first deck assembly 20 includes a pair of first deck wheel connection assemblies 28 coupled to an underside of the first deck support plate 26 at a first end of the first deck support plate 26. The first deck wheel connection assemblies 28 extend downwardly from the underside of the first deck support plate 26.

The first deck assembly 20 includes an elongate pad member 25 coupled to the first deck support plate 26. The elongate pad member 25 extends between the side rails 22 proximate the first end of the support plate 26.

The second deck 40 assembly includes a pair of second deck side rails 42 and a second deck support plate 46 which extends between the second deck side rails 42. The second deck side rails 42 each includes a connection portion 43 which extends outwardly from a first end of the side rail 42.

Each second deck rail connection portion 43 is positioned for selectively inserting into the open end 23 of an associated one of the first deck side rails 22 such that the first deck support plate 26 is aligned with the second deck support plate 46.

Each second deck rail connection portion 43 includes a pin member 44 pivotally coupled to an outwardly facing wall of the second deck rail connection portion 43. The pin member 44 is positioned for engaging the aperture 24 in an the associated first deck side rail 22 when the second deck rail connection portion 43 is inserted into the open end 23 of the associated first deck side rail 22. Thus, the second deck assembly 40 is secured to the first deck assembly 20.

The second deck assembly 40 includes a pair of second deck wheel connection assemblies 48 coupled to an underside of the second deck support plate 46 at a second end of the second deck support plate 46 such that the second deck wheel connection assemblies 48 extend downwardly from the underside of the second deck support plate 46.

The seat assembly 60 includes a pair of seat side rails 62. Each seat side rail 62 includes a lower portion, an upper portion, and opposite end portions which extend between the lower and upper portions of the seat side rail 62.

The seat assembly 60 includes a planar lower seat support plate 66 which extends between the lower portions of the seat side rails 62. Each of the lower portions of the seat side rails 62 includes an associated seat side rail open end 63 and an associated seat side real aperture 64 positioned in an outwardly facing wall of the associated lower portion of the seat side rail 62.

The seat assembly 60 includes a pair of seat wheel connection assemblies 68 coupled to an underside of the seat support plate 66 at a first end of the lower seat support plate 66 such that the seat wheel connection assemblies 68 extend downwardly from the underside of the lower seat support plate 66.

In an embodiment the opposite end portions of the seat side rails 62 are angled relative to the upper and lower portions of the seat side rails 62. Thus an upper end of each of the opposite end portions extends upwardly and outwardly away from the first end of the lower seat support plate 66.

A seat upper support plate 65 extends between upper portions of the seat side rails 62. A seat pad member 67 is coupled to the upper seat support plate 65. The seat pad member 67 extends between the upper portions of the seat side rails 62.

Each of the second deck rail connection portions 43 is positioned for selectively inserting into the open end 63 of an associated one of the seat side rails 62 such that the lower seat support plate 66 is aligned with the second deck support plate 46.

The pin member 44 is positioned for engaging the aperture 64 in an the associated seat side rail 62 when the second deck rail connection portion 43 is inserted into the open end 63 of the associated seat side rail 62 for coupling the seat assembly 60 to the second deck assembly 40. Thus the seat assembly 60 and the first deck assembly 20 are interchangeably couplable to the second deck assembly 40.

Each of the plurality of wheel assemblies 30 is couplable to a selectable one of the first deck wheel connection assemblies 28, the second deck wheel connection assemblies 48, and the seat wheel connection assemblies 68.

Each wheel assembly 30 includes a female connection member and a wheel coupled to the female connection member.

Each first deck wheel connection assembly 28 includes a first deck male connection member which is couplable to the female connection member of each the wheel assembly 30.

Each second deck wheel connection assembly 48 includes a second deck male connection member which is couplable to the female connection member of each the wheel assembly 30.

Each seat wheel connection assembly 68 includes a seat male connection member which is couplable to the female connection member of each the wheel assembly 30.

Each of the plurality of spacing members 50 is couplable to a selectable one of the first deck wheel connection assemblies 28, the second deck wheel connection assemblies 48, and the seat wheel connection assemblies 68. Each spacing member 50 is also couplable to a selectable one of the wheel assemblies 30 for facilitating supporting a user at a selectable height.

Each spacing member 50 includes a spacing member female connection portion which is couplable to the male connection member. The first deck male connection member is selectively couplable to each the, spacing female connection portion. The second deck male connection member is selectively couplable to each the spacing member female connection portion. The seat male connection member is selectively couplable to each the spacing member female connection portion.

Each spacing member 50 includes a spacing member male connection portion selectively couplable to the female connection member of each the wheel assembly 30.

In use, the user selects either the first deck assembly for a recumbent position, or the seat assembly for a sitting position. The user then inserts the connection portions of the second deck assembly into the open end of the selected first deck assembly or seat assembly. The connection portions are inserted until the pin members protrude through the apertures of the side members of the selected assembly. The user then selects the appropriate spacer members for the desired height. The female end of the spacer members are coupled to the wheel connector assemblies, and the male ends of the spacer assemblies are coupled to the wheel assemblies.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A transformable mechanics creeper assembly comprising:

a first deck assembly having a pair of first deck side rails and a first deck support plate extending between said first deck side rails, each of said first deck side rails having an associated open end and an associated aperture positioned in an outwardly facing wall of said associated side rail;

a seat assembly having a pair of seat side rails, each seat side rail having a lower portion, an upper portion, and opposite end portions extending between said lower and upper portions of said seat side rail;

a second deck assembly having a pair of second deck side rails and a second deck support plate extending between said second deck side rails, said second deck side rails each having a connection portion extending outwardly from a first end of said side rail;

said second deck assembly being selectively couplable to said first deck assembly;

said seat assembly being selectively couplable to said second deck assembly; and a plurality of wheel assemblies, each wheel assembly being couplable to a selectable one of said first deck assembly, said second deck assembly and said seat assembly;

said first deck assembly having a pair of first deck wheel connection assemblies coupled to an underside of said first deck support plate at a first end of said first deck support plate such that said first deck wheel connection assemblies extend downwardly from said underside of said first deck support plate;

each of said wheel assemblies being selectively couplable to a selectable one of said first deck wheel connection assemblies;

each wheel assembly including a female connection member and a wheel coupled to said female connection member; and each first deck wheel connection assembly including a first deck male connection member couplable to said female connection member of each said wheel assembly.

2. The transformable mechanic's creeper assembly of claim 1, further comprising:

each second deck rail connection portion including a pin member coupled to an outwardly facing wall of said second deck rail connection portion, said pin member being positioned for engaging said aperture in said associated first deck side rail when said second deck rail connection portion is inserted into said open end of said associated first deck side rail whereby said second deck assembly is secured to said first deck assembly.

3. The transformable mechanic's creeper assembly of claim 1, further comprising:

said seat assembly having a pair of seat wheel connection assemblies coupled to an underside of a lower seat support plate at a first end of said lower seat support plate such that said seat wheel connection assemblies extend downwardly from said underside of said lower seat support plate; and each of said wheel assemblies being selectively couplable to a selectable one of said seat wheel connection assemblies.

4. The transformable mechanic's creeper assembly of claim 3, further comprising:

each wheel assembly including a female connection member and a wheel coupled to said female connection member;

each seat wheel connection assembly including a seat male connection member couplable to said female connection member of each said wheel assembly.

5. The transformable mechanic's creeper assembly of claim 1, further comprising:

said first deck assembly having an elongate pad member coupled to said first deck support plate.

6. The transformable mechanic's creeper assembly of claim 5, further comprising:

said elongate pad member extending between said side rails proximate said first end of said support plate.

7. The transformable mechanic's creeper assembly of claim 1, further comprising:

each second deck rail connection portion being positioned for selectively inserting into said open end of an associated one of said first deck side rails such that said first deck support plate is aligned with said second deck support plate.

8. The transformable mechanic's creeper assembly of claim 1, further comprising:

said second deck assembly having a pair of second deck wheel connection assemblies coupled to an underside of said second deck support plate at a second end of said second deck support plate such that said second, deck wheel connection assemblies extend downwardly from said underside of said second deck support plate; and each of said wheel assemblies being selectively couplable to a selectable one of said second deck wheel connection assemblies.

9. The transformable mechanic's creeper assembly of claim 8, further comprising:

each wheel assembly including a female connection member and a wheel coupled to said female connection member;

each second deck wheel connection assembly including a second deck male connection member couplable to said female connection member of each said wheel assembly.

10. The transformable mechanics creeper of claim 1 further comprising:

said first deck assembly having a pair of first deck wheel connection assemblies coupled to an underside of said first deck support plate at a first end of said first deck support plate such that said first deck wheel connection assemblies extend downwardly from said underside of said first deck support plate;

said second deck assembly having a pair of second deck wheel connection assemblies coupled to an underside of said second deck support plate at a second end of said second deck support plate such that said second, deck wheel connection assemblies extend downwardly from said underside of said second deck support plate;

said seat assembly having a pair of seat wheel connection assemblies coupled to an underside of said seat support plate at a first end of said lower seat support plate such that said seat wheel connection assemblies extend downwardly from said underside of said lower seat support plate; and each wheel assembly being couplable to a selectable one of said first deck wheel connection assemblies, said second deck wheel connection assemblies and said seat wheel connection assemblies.

11. A transformable mechanics creeper assembly comprising:

a first deck assembly having a pair of first deck side rails and a first deck support plate&, extending between said first deck side rails, each of said first deck side rails having an associated open end and an associated aperture positioned in an outwardly facing wall of said associated side rail;

a seat assembly having a pair of seat side rails, each seat side rail having a lower portion, an upper portion, and opposite end portions extending between said, lower and upper portions of said seat side rail;

a second deck assembly having a pair of second deck side rails and a second deck support plate extending between said second deck side rails, said second deck side rails each having a connection portion extending outwardly from a first end of said side rail;

said second deck assembly being selectively couplable to said first deck assembly;

said seat assembly being selectively couplable to said second deck assembly;

a plurality of wheel assemblies, each wheel assembly being couplable to a selectable one of said first deck assembly, said second deck assembly and said seat assembly; and said seat assembly including a planar lower seat support plate extending between said lower portions of said seat side rails, each of said lower portions of said seat side rails having an associated seat side rail open end and an associated seat side rail aperture positioned in an outwardly facing wall of said associated lower portion of said seat side rail.

12. The transformable mechanic's creeper assembly of claim 11, further comprising:

a seat upper support plate extending between upper portions of said seat side rails.

13. The transformable mechanic's creeper assembly of claim 12, further comprising:

a seat pad member coupled to said upper seat support plate, said seat pad member, extending between said upper portions of said seat side rails.

14. The transformable mechanic's creeper assembly of claim further comprising:

wherein said opposite end portions of said seat side rails are angled relative to said upper and lower portions of said seat side rails whereby an upper end of each said opposite end portion extends upwardly and outwardly away from said first end of said lower seat support plate.

15. A transformable mechanics creeper assembly comprising:

a first deck assembly having a pair of first deck side rails and a first deck support plate extending between said first deck side rails, each of said first deck side rails having an associated open end and an associated aperture positioned in an outwardly facing wall of said associated side rail;

a seat assembly having a pair of seat side rails, each seat side rail having a lower portion; an upper portion, and opposite end portions extending between said lower and upper portions of said seat side rail;

a second deck assembly having a pair of second deck side rails and a second deck support plate extending between said second deck side rails, said second deck side rails each having a connection portion extending outwardly from a first end of said side rail;

said second deck assembly being selectively couplable to said first deck assembly;

said seat assembly being selectively couplable to said second deck assembly;

a plurality of wheel assemblies, each wheel assembly being couplable to a selectable one of said first deck assembly, said second deck assembly and said seat assembly;

each second deck rail connection portion being positioned for selectively inserting into an open end of an associated one of said seat side rails such that a lower seat support plate is aligned with said second deck support plate;

a pin member being positioned for engaging an aperture in said associated seat side rail when said second deck rail connection portion is inserted into said open end of said associated seat side rail for coupling said seat assembly to said second deck assembly whereby said seat assembly and said first deck assembly are interchangably couplable to said second deck assembly.

16. A transformable mechanics creeper assembly comprising:

a first deck assembly having a pair of first deck side rails and a first deck support plate extending between said first deck side rails, each of said first deck side rails having an associated open end and an associated aperture positioned in an outwardly facing wall of said associated side rail;

a seat assembly having a pair of seat side rails, each seat side rail having a lower portion an upper portion, and opposite end portions extending between said lower and upper portions of said seat side rail;

a second deck assembly having a pair of second deck side rails and a second deck support plate extending between said second deck side rails, said second deck[]side rails each having a connection portion extending outwardly from a first end of said side rail;

said second deck, assembly being selectively couplable to said first deck assembly;

said seat assembly being selectively couplable to said second deck assembly;

a plurality of wheel assemblies, each wheel assembly being couplable to a selectable one of said first deck assembly, said second deck assembly and said seat assembly;

said first deck assembly having a pair of first deck wheel connection assemblies coupled to an underside of said first deck support plate at a first end of said first deck support plate such that said first deck wheel connection assemblies extend downwardly from said underside of said first deck support plate;

said second deck assembly having a pair of second deck wheel connection assemblies coupled to an underside of said second deck support plate at a second end of said second deck support plate such that said second deck wheel connection assemblies extend downwardly from said underside of said second deck support plate;

said seat assembly having a pair of seat wheel connection assemblies coupled to an underside of said seat support plate at a first end of said lower seat support plate such that said seat wheel connection assemblies extend downwardly from said underside of said lower seat support plate;

each wheel assembly being couplable to a selectable one of said first deck wheel connection assemblies, said second deck wheel connection assemblies and said seat wheel connection assemblies; and a plurality of spacing members, each spacing member being couplable to a selectable one of said first deck wheel connection assemblies, said second deck wheel connection assemblies and said seat wheel connection assemblies, each spacing member further being couplable to a selectable one of said wheel assemblies for facilitating supporting a user at a selectable height.

17. The transformable mechanics creeper of claim 16, further comprising:

each spacing member including a spacing member female connection portion couplable to a male connection member, a first deck male connection member being selectively couplable to each said spacing female connection portion, a second deck male connection member being selectively couplable to each said spacing member female connection portion, a seat male connection member being selectively couplable to each said spacing member female connection portion; and each spacing member including a spacing member male connection portion selectively couplable to said female connection member of each said wheel assembly.

18. A transformable mechanic's creeper assembly comprising:

a first deck assembly having a pair of first deck side rails and a planar first deck support plate extending between said first deck side rails, each of said first deck side rails having an associated open end and an associated aperture positioned in an outwardly facing wall of said associated side rail;

said first deck assembly having a pair of first deck wheel connection assemblies coupled to an underside of said first deck support plate at a first end of said first deck support plate such that said first deck wheel connection assemblies extend downwardly from said underside of said first deck support plate;

said first deck assembly having an elongate pad member coupled to said first deck support plate, said elongate pad member extending between said side rails proximate said first end of said support plate;

a second deck assembly having a pair of second deck side rails and a second deck support plate extending between said second deck side rails, said second deck-:'side rails each having a connection portion extending outwardly from a first end of said side rail;

each second deck rail connection portion being positioned for selectively inserting in:to said open end of an associated one of said first deck side rails such that said first deck support plate is aligned with said second deck support plate;

each second deck, rail connection portion including a pin member coupled to an outwardly facing wall of said second deck rail connection portion, said pin member being positioned for engaging said aperture in said associated first deck side rail when said second deck rail connection portion is inserted into said open end of said associated first deck side rail whereby said second deck assembly is secured to said first deck assembly;

said second deck assembly having a pair of second deck wheel connection assemblies coupled to an underside of said second deck support plate at a second end of said second deck support plate such that said second deck wheel connection assemblies extend downwardly from said underside of said second deck support plate;

a seat assembly having a pair of seat side rails, each seat side rail having a lower portion, an upper portion, and opposite end portions extending between said lower and upper portions of said seat side rail;

said seat assembly including a planar lower seat support plate extending between said lower portions of said seat side rails, each of said lower portions of said seat side rails having an associated seat side rail open end and an associated seat side rail aperture positioned in an outwardly facing wall of said associated lower portion of said seat side rail;

said seat assembly having a pair of seat wheel connection assemblies coupled to an underside of said seat support plate at a first end of said lower seat support plate such that said seat wheel connection assemblies extend downwardly from said underside of said lower seat support plate;

wherein said opposite end portions of said seat side rails are angled relative to said upper and lower portions of said seat side rails whereby an upper end of each said opposite end portion extends upwardly and outwardly away from said first end of said lower seat support plate;

a seat upper support plate extending between upper portions of said seat side rails;

a seat pad member coupled to said upper seat support plate, said seat pad member extending between said upper portions of said seat side rails;

each second deck rail connection portion being positioned for selectively inserting into said open end of an associated one of said seat side rails such that said lower seat support plate is aligned with said second deck support plate;

said pin member being positioned for engaging said aperture in said associated seat side rail when said second deck rail connection portion is inserted into said open end of said associated seat side rail for coupling said seat assembly to said second deck assembly whereby said seat assembly and said first deck assembly are interchangably couplable to said second deck assembly;

a plurality of wheel assemblies, each wheel assembly being couplable to a selectable one of said first deck wheel connection assemblies, said second deck wheel connection assemblies and said seat wheel connection assemblies;

each wheel assembly including a female connection member and a wheel coupled to said female connection member;

each first deck wheel connection assembly including a first deck male connection member couplable to said female connection member of each said wheel assembly;

each second deck wheel connection assembly including a second deck male connection member couplable to said female connection member of each said wheel assembly;

each seat wheel connection assembly including a seat male connection member couplable to said female connection member of each said wheel assembly;

a plurality of spacing members, each spacing member being couplable to a selectable one of said first deck wheel connection assemblies, said second deck wheel connection assemblies and said seat wheel connection assemblies, each spacing member further being couplable to a selectable one of said wheel assemblies for facilitating supporting a user at a selectable height;

each spacing member including a spacing member female connection portion couplable to an associated one of said first, second, and seat male connection members, said first deck male connection member being selectively couplable to each said spacing female connection portion, said second deck male connection member being selectively couplable to each said spacing member female connection portion, said seat male connection member being selectively couplable to each said spacing member female connection portion; and each spacing member including a spacing member male connection portion selectively couplable to said female connection member of each said wheel assembly.

* * * * *